US005614120A

United States Patent [19]

Wenzel

[11] Patent Number: 5,614,120

[45] Date of Patent: Mar. 25, 1997

[54] SLEEVING FOR A WIRE USED WITH A TAIL CONNECTED TO A HEATING ELEMENT AND A METHOD FOR HEATING

[75] Inventor: David W. Wenzel, Lake City, Minn.

[73] Assignee: Stresstech, Red Wing, Minn.

[21] Appl. No.: 338,328

[22] Filed: Nov. 14, 1994

[51] Int. Cl.[6] ..... H05B 3/08; H01C 1/02

[52] U.S. Cl. ..... 219/535; 219/541; 219/549; 174/111; 338/273; 338/213

[58] Field of Search ..... 219/535, 542, 219/536, 541, 550, 552, 549; 338/273, 213, 214; 174/110 R, 111, 88 C, 84 C, 102 R, 103, 36

[56] References Cited

U.S. PATENT DOCUMENTS

| | | | |
|---|---|---|---|
| 1,575,656 | 3/1926 | Strafford et al. | 174/84 C |
| 2,740,101 | 3/1956 | Betts | 174/84 C |
| 2,806,215 | 9/1957 | Redslob | 174/84 C |
| 3,036,187 | 5/1962 | Goldstaub et al. | 219/535 |
| 3,694,628 | 9/1972 | McGwire et al. | 219/535 |
| 4,121,093 | 10/1978 | Wainwright | 219/541 |
| 4,241,292 | 12/1980 | Kreick et al. | 219/541 |
| 4,275,375 | 6/1981 | Vallance | 174/84 C |
| 4,464,565 | 8/1984 | Spangler | 219/535 |
| 4,531,049 | 7/1985 | Sato | 219/549 |
| 4,634,213 | 1/1987 | Larsson et al. | 174/84 R |

*Primary Examiner*—Tu B. Hoang
*Assistant Examiner*—Sam Paik
*Attorney, Agent, or Firm*—Hill, Steadman & Simpson

[57] ABSTRACT

A heating element having at least one tail is provided for connection to an electrical source. The tail includes an electrically conductive wire with a sleeving around at least a portion thereof. The wire and sleeving are connected to a tubing and crimped for receipt within a connector. The connector is provided to receive the tubing and to connect to the voltage source allowing electric heat to pass through the length of electrically conductive wire and to thereby heat the heating element. The heating section is particularly suitable for pre-heating and post-stress weld stress relieving piping welds.

17 Claims, 1 Drawing Sheet

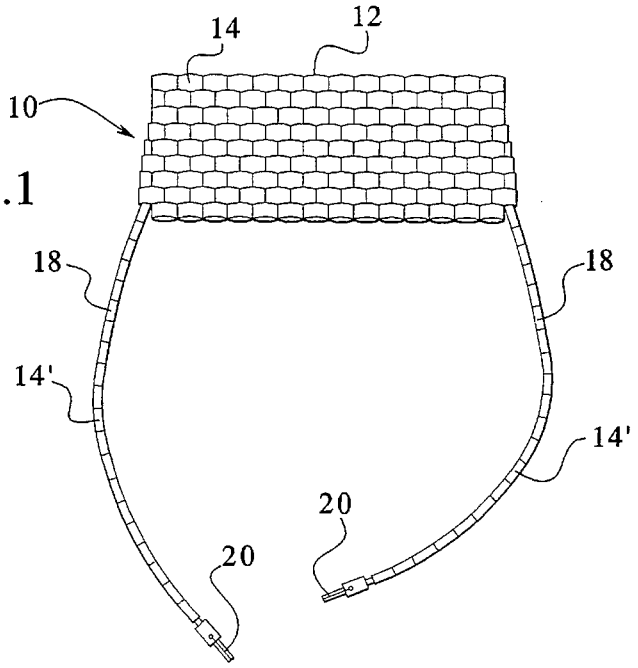
FIG.1
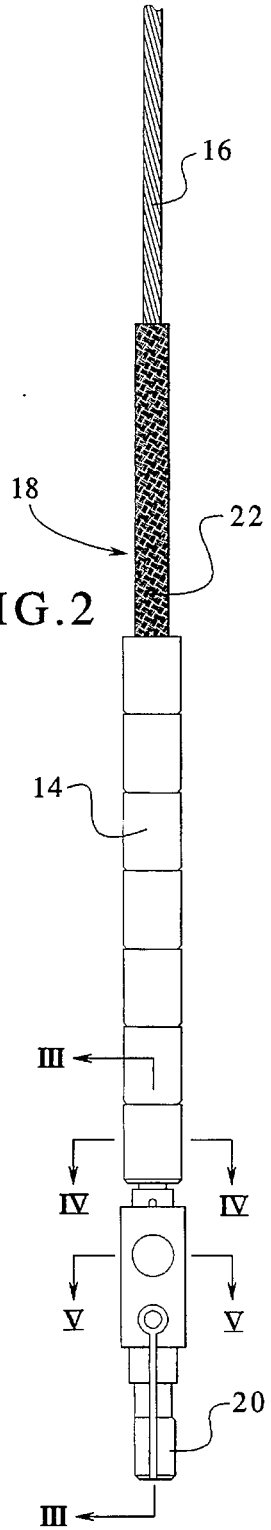
FIG.2
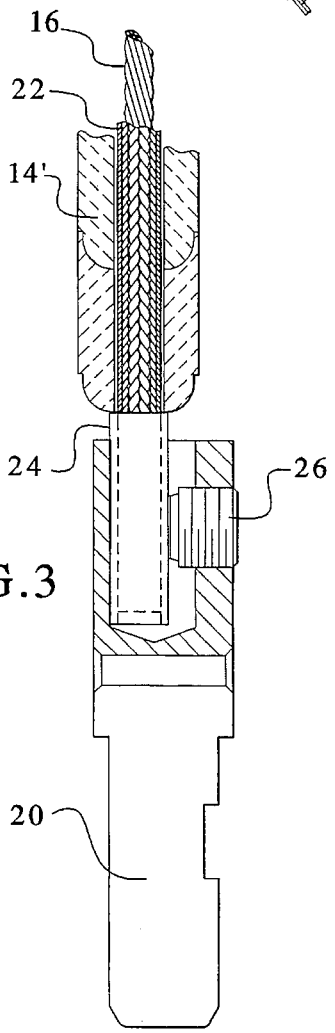
FIG.3
FIG.4
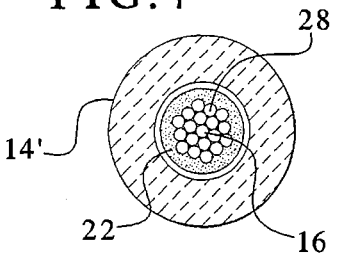
FIG.5
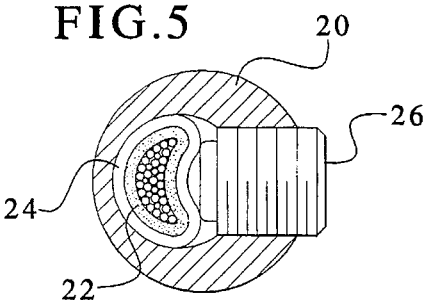

SLEEVING FOR A WIRE USED WITH A TAIL CONNECTED TO A HEATING ELEMENT AND A METHOD FOR HEATING

BACKGROUND OF THE INVENTION

The present invention generally relates to tail construction for heating elements. More specifically, the present invention relates to ceramic heating elements with tails constructed such that the tails heat to substantially lower temperatures than normal "hot tail" construction.

Ceramic heating elements are, of course, generally known and used in the construction industry. Typically, ceramic heating elements are used for pre-heating and post-weld stress relieving piping welds. The most common form of heating element consists of interlocking ceramic beads for electrical insulators forming a flat pad. Typically, the flat pads are approximately three-eighths (⅜") of an inch thick but may vary depending on the beads or other insulators used. Typically, the beads are strung together using 80/20 nichrome wire to form a continuous circuit. The two ends of the wire extend from the corners of a heating element consisting of strung-together ceramic beads. The ends of the wires extend for a sufficient distance to allow for electrical connection of the wires to a source.

The wire leads are commonly called "tails" in the industry and are designed as either "hot" tails or "cold" tails. Each type of tail, however, has its drawbacks.

Hot tail construction connects the resistant wire producing the heat inside the heating element directly to an electrical connector at the end of the tail. Typical electrical connectors are made from brass, but other connectors, of course, may be implemented. As a voltage is applied to the tails of the heating element, electrical current flows through the wire. Typical voltages of eighty volts are applied resulting in a current of approximately sixty Amperes thereby causing the temperature of the nichrome wire to rise. Since the nichrome wire is connected directly to the terminals, each of the terminals also become hot. This type of construction is beneficial in that a continuous wire is connected to the electrical connector resulting in no weak points in the heating element or the tails.

Alternatively, cold tails are provided having a different form of construction than hot tails. Cold tails are constructed so as to lower the resistance of the wire leads thereby lowering the temperature of the tail itself. Typically, cold tails are constructed by one of two methods.

One method of construction of a cold tail is to place a second nichrome wire adjacent to the existing wire in the tail. A metal tube is then slid over both wires up to the main heating element body and crimped to produce an electrical connection. Both of the wires are then run into the electrical connector, typically constructed from brass. Having two wires, the electrical resistance is only one-half of the original amount producing only one-fourth of the heat generated in a system using hot tail construction. Therefore, the connector is substantially cooler. However, this results in several drawbacks.

One drawback is that the tails are flexible and, therefore, the point at which the metal sleeve is crimped becomes a weak point. The crimped sleeve cuts the small individual strands of the heating wire causing a hot spot which fails earlier than any other point on the wire. A second drawback is that a manufacturer of heating elements must also stock and use a different ceramic bead to insulate the tail since the tail has a larger inside diameter than the outer beads needed for the remainder of the heating element.

Another type of cold tail construction involves butt welding of the nichrome wire at the point at which it exits the main heating element. The nichrome wire is butt welded to a nickel wire of the same size. Nickel wire has a substantially lower resistance than the nichrome wire resulting in a lower temperature at the connector. A butt weld, however, is typically difficult to construct. The two wires must be welded together without changing the diameter of the joint. Further, the weld must appear as one continuous wire. Any reduction in diameter causes a hot spot which fails early after use. Any increase in diameter prevents the ceramic insulators from sliding over the joint. Furthermore, any contamination in the weld causes the joint to heat up. Therefore, a clean environment is required to manufacture this type of cold tail.

A need, therefore, exists for an improved tail for heating elements and a method for heating overcoming the deficiencies of the known tail constructions and combining the advantages of both hot tail construction and cold tail construction.

SUMMARY OF THE INVENTION

The present invention provides a tail for connection to a heating element, particularly suitable for heating of a piping weld. The tail and the heating element provide an arrangement having a cold tail with the advantages of known hot tails.

To this end, in an embodiment, a tail for operative connection to a heating element is provided. The tail comprises an electrical conductive wire having a length extending from the heating element a distance sufficient to connect a voltage source at an end thereof. A sleeving is constructed and arranged to substantially cover at least a portion of the electrically conductive wire wherein the sleeving extends from the end of the electrically conductive wire. A tubing is constructed and arranged to crimp the end of the electrically conductive wire and the sleeve, and a connector is constructed and arranged to receive the tubing and to connect the voltage source.

In an embodiment, the sleeving of the tail of the present invention is substantially made from nickel-plated copper.

In an embodiment, the tubing of the tail of the present invention is substantially made from copper.

In an embodiment, the connector of the tail of the present invention is substantially made from brass.

In an embodiment, the tail further comprises a set screw constructed and arranged to secure the connector and the tubing.

In an embodiment, the tail further comprises a plurality of insulators constructed and arranged to substantially cover the electrically conductive wire and the sleeving between the heating element and the connector.

In an embodiment, the plurality of insulators are ceramic beads.

In an embodiment, flexibilities of the electrical conductive wire and the sleeving are substantially identical.

In another embodiment, a heating element is provided. The heating element comprises a heating section and at least one tail operatively connected to the heating section and connectable to a voltage source. The at least one tail has an electrically conductive wire covered with a sleeving extending from an end of the wire and a tubing crimping the end of the wire and the sleeving.

In an embodiment, the heating element further comprises a connector constructed and arranged to receive the crimped tubing.

In another embodiment of the present invention, a method is provided for heating a piping weld. The method comprises the steps of: providing a power source; providing a heating section; connecting the heating section by applying an electrically conductive wire between the heating section and the power source; wrapping the electrically conductive wire in a braided sleeving, crimping a tubing around the electrically conductive wire and the braided sleeving; and applying a voltage from the power source to the tubing creating electrical heat in the heating section.

In an embodiment, the method further comprises the step of providing a connector to receive the tubing prior to applying the voltage.

In an embodiment, the method further comprises the step of securing the tubing in the connector.

In an embodiment, the method further comprises the step of providing a plurality of insulators received on the electrical wire of the heating section.

It is, therefore, an advantage of the present invention to provide a tail which has a substantially cooler temperature than the tails of the prior art with the advantages of the hot tail of the prior art.

Another advantage of the present invention is to provide a tail for operative connection to a heating element and subsequent connection to a voltage source without creating hot spots resulting in weak points and failure points.

A still further advantage of the present invention is to provide a tail and a method for heating which is inexpensive to manufacture.

Moreover, another advantage of the present invention is to provide a tail for a heating element and a method for heating which is simple to manufacture and use.

And, another advantage of the present invention is to provide a tail for a heating element which may be manufactured without welding.

These and other advantages of the present invention will be described in and will be apparent from the detailed description of the presently preferred embodiments and from the drawings.

BRIEF DESCRIPTION OF THE DRAWINGS

FIG. 1 illustrates a perspective view of a heating element with the tails of the present invention.

FIG. 2 illustrates a plan view of the tail of the present invention.

FIG. 3 illustrates a partial cross-sectional view taken generally along the line III—III of FIG. 2.

FIG. 4 illustrates a cross-sectional view taken generally along the line IV—IV of FIG. 2.

FIG. 5 illustrates a cross-sectional view taken generally along the line V—V of FIG. 2.

DETAILED DESCRIPTION OF THE PRESENTLY PREFERRED EMBODIMENTS

Heating elements and tails associated therewith are provided. The heating elements are typically used in the construction industry for pre-heating and post-weld stress relieving piping welds. While ceramic heating elements are illustrated in the figures, the present invention is not to be construed as limited to such heating elements but may be embodied by any connection between a length of electrically conductive wire to a voltage source for heating same.

Referring now to the drawings wherein like numerals refer to like parts, FIG. 1 generally illustrates a ceramic heating element designated at numeral 10. While a rectangular-shaped pad section 12 is illustrated, the heating element itself may be any shape or, alternatively, may be a length of beads or electrical insulators connected to the tail of the present invention.

The heating element 10 illustrated includes a plurality of beads 14 strung together by a length of electrical conductive wire 16 more clearly illustrated in FIG. 2. The beads 14, typically ceramic, are interlocked as illustrated in FIG. 1 to form the pad section 12. At each end of the pad section 12 is a tail section 18. At each end of the tail sections 18 are electrical connectors 20. The electrical connectors 20 connect to a voltage source (not shown) such that a voltage is applied to each of the tail sections 18 at the electrical connectors 20. Each of the tail sections 18 also include beads 14' extending between the respective electrical connectors 20 and the pad section 12. The beads 14', also preferably ceramic, may be identically or differently sized from the beads 14 of the pad section 12.

Referring now to FIG. 2, the tail section 18 is generally illustrated. The tail section 18 includes the electrically conductive wire 16 with a sleeving 22 over at least a portion of the wire 16 of the tail section 18. In a preferred embodiment, nickel-plated copper braided sleeving extends over the wire 16 and a portion of the length of the tail section 18. However, the sleeving 22 may extend completely between the pad section 12 and the electrical connector 20. The inside diameter of the braided sleeving 22 is equal to the diameter/size of the wire 16 creating an electrical connection along the entire length thereof. The inside diameters of the beads 14' are substantially equivalent to the outside diameter of the sleeving 22.

Tubing 24, in a preferred embodiment, copper tubing, is crimped over the combination of the sleeving 22 with the wire 16. The combination including the copper tubing 24 is inserted into the connector 20 typically constructed from brass. The end is then secured within the connector 20 as illustrated in FIG. 3 by a set screw 26 or any other similar lug. The set screw 26 secures the crimped end within the connector 20. The combination of the tubing 24 with the sleeving 22 and the wire 16 within the connector 20 allows for heat transfer to the pad section 12 following electrical connection to, for example, a voltage source.

The sleeving 22 placed over the wire 16 providing a source of electrical heat to the main heating element 10 lowers the resistance of the tail 18 near the brass connector 20. As a result of the lower resistance, less heat is generated with current flowing through the wire 16 providing for the substantially cooler connector 20 than typically associated with a tail having the advantages of hot tail construction. The flexible stranding of the sleeving 22 substantially matches the flexibility of the stranding in the heating wire 16. As a result, rigid points are eliminated, i.e. a crimped sleeve or a welded joint that often causes the individual strands 28 (FIG. 4) of the main heating wire 16 to break with repeated bending or other movement.

The present invention provides a tail which is both economical to construct and includes the advantages of a hot tail design while maintaining a substantially lower temperature at the electrical connector.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A tail for operative connection to a heating element, the tail comprising:

an electrically conductive wire having a first end and a second end defining a length wherein the wire extends continuously at the first end from the heating element a distance sufficient to connect a voltage source at the second end thereof;

a sleeving constructed and arranged to substantially cover at least a portion of the electrically conductive wire, the sleeving extending a finite distance starting at the second end and ending before reaching the first end of the electrically conductive wire;

a tubing constructed and arranged to crimp the second end of the electrically conductive wire and the sleeving; and a connector constructed and arranged at the second end to receive the tubing and to connect the voltage source.

2. The tail of claim 1 wherein the sleeving is substantially made from nickel-plated copper.

3. The tail of claim 1 wherein the tubing is substantially made from copper.

4. The tail of claim 1 wherein the connector is substantially made from brass.

5. The tail of claim 1 further comprising:

a set screw constructed and arranged to secure the connector and the tubing.

6. The tail of claim 1 further comprising:

a plurality of insulators constructed and arranged to substantially cover the electrically conductive wire and the sleeving between the heating element and the connector.

7. The tail of claim 6 wherein the plurality of insulators are ceramic beads.

8. The tail of claim 1 wherein flexibilities of the electrical conductive wire and the sleeving are substantially identical.

9. A heating element comprising:

a heating section; and at least one tail having a length defined between a first end and a second end wherein the first end is operatively connected to the heating section and the second end is connectable to a voltage source, the at least one tail having a continuous electrically conductive wire covered with a sleeving extending a finite distance starting at the second end of the tail and ending before reaching the first end to encircle the wire extending the length of the tail, and a finite length of tubing crimping the second end of the wire and the sleeving.

10. The heating element of claim 9 further comprising:

a connector constructed and arranged to receive the crimped tubing.

11. The heating element of claim 9 wherein the heating section includes a plurality of insulators interconnected by the electrically conductive wire.

12. The heating element of claim 10 further comprising:

a set screw constructed and arranged to secure the connector and the tubing.

13. The heating element of claim 11 wherein the plurality of insulators are ceramic beads.

14. A method for heating a piping weld, the method comprising the steps of:

providing a power source;

providing a heating section;

connecting the heating section by an electrically conductive wire continuously extending between the heating section and the power source;

wrapping the electrically conductive wire in a sleeving wherein the sleeving extends a finite distance starting at the power source and ending before reaching the heating section;

crimping a tubing around the electrically conductive wire and the sleeving; and applying a voltage from the power source to the tubing creating electrical heat in the heating section.

15. The method of claim 14 further comprising the step of:

providing a connector to receive the tubing prior to applying the voltage.

16. The method of claim 14 further comprising the step of:

securing the tubing in the connector.

17. The method of claim 14 further comprising the step of:

providing a plurality of insulators received on the electrical wire of the heating section.

* * * * *